US008398379B2

(12) United States Patent
Yajima

(10) Patent No.: US 8,398,379 B2
(45) Date of Patent: Mar. 19, 2013

(54) CHEMICAL LIQUID SUPPLYING APPARATUS

(75) Inventor: Takeo Yajima, Tokyo (JP)

(73) Assignee: Koganei Corporation, Tokyo (JP)

( * ) Notice: Subject to any disclaimer, the term of this patent is extended or adjusted under 35 U.S.C. 154(b) by 0 days.

(21) Appl. No.: 13/225,927

(22) Filed: Sep. 6, 2011

(65) Prior Publication Data

US 2011/0318206 A1 Dec. 29, 2011

Related U.S. Application Data

(62) Division of application No. 11/855,200, filed on Sep. 14, 2007, now Pat. No. 8,047,814.

(30) Foreign Application Priority Data

Oct. 18, 2006 (JP) ..... 2006-283555

(51) Int. Cl.
*F04B 35/02* (2006.01)
*F04B 9/08* (2006.01)

(52) U.S. Cl. ..... 417/385; 417/383

(58) Field of Classification Search ..... 417/375, 417/379, 383, 389, 394, 395
See application file for complete search history.

(56) References Cited

U.S. PATENT DOCUMENTS 2,853,015 A * 9/1958 Pleuger ..... 417/389
3,492,946 A * 2/1970 Martin ..... 417/568
3,945,770 A * 3/1976 Welker ..... 417/401
8,047,814 B2 * 11/2011 Yajima ..... 417/385

* cited by examiner

*Primary Examiner* — Peter J Bertheaud
(74) *Attorney, Agent, or Firm* — McCormick, Paulding & Huber LLP

(57) ABSTRACT

A chemical liquid supplying apparatus which can discharge chemical liquid with high accuracy is provided. The apparatus is used to discharge the chemical liquid in a chemical liquid tank from an application nozzle. The apparatus has a combined member formed integrally with a pump case and a cylinder, and a flexible tube serving as a pump member is provided in the pump case, wherein its inside is a pump chamber and its outside is a pump-side driving chamber. A piston is assembled to the cylinder and when the piston is reciprocated by a motor, the pump chamber is expanded and contracted. A gap between the piston and the cylinder is covered with a diaphragm, and an interior of the diaphragm is a seal space. Therefore, an incompressible medium having leaked from the gap between the piston and the cylinder enters into the seal space and does not leak to the outside.

4 Claims, 4 Drawing Sheets

CHEMICAL LIQUID SUPPLYING APPARATUS

CROSS-REFERENCE TO RELATED APPLICATIONS

This application is a Divisional Application of U.S. patent application Ser. No. 11/855,200 filed on Sep. 14, 2007, and claims the benefit of the filing date thereof under 35 USC §120. The present invention also claims priority from Japanese Patent Application No.: 2006-283555 filed on Oct. 18, 2006, the contents of which are hereby incorporated by reference in their entirety.

TECHNICAL FIELD OF THE INVENTION

The present invention relates to a chemical liquid supplying apparatus that discharges a predetermined amount of chemical liquid such as photoresist liquid.

BACKGROUND OF THE INVENTION

A fine circuit pattern is produced on a surface of a semiconductor wafer or glass substrate by a photolithographic step and an etching step. In the photolithographic step, a chemical liquid supplying apparatus is used to apply the chemical liquid such as photoresist liquid onto the surface of the wafer or glass substrate. By doing so, the chemical liquid accommodated in a container is sucked up by a pump, passes through a filter etc., and is applied from a nozzle onto a material to be applied such as a wafer. When particles such as dusts have been mixed in the chemical liquid to be applied, they adhere to the material to be applied, thereby causing pattern defects and resulting in lowering a yield of products. If the chemical liquid stays in the pump for a long term, it changes in quality. Therefore, since the chemical liquid changed in quality becomes particles in some cases, it is required that there is no chemical liquid accumulation in the pump for discharging the chemical liquid.

As the pump for discharging the chemical liquid, there is used such a pump that an expansion/contraction chamber in which the chemical liquid flows and a pump chamber are partitioned from each other by an elastically deformable partition membrane such as an diaphragm, tube, or the like. By doing so, the pump chamber is filled with indirect liquid, namely, an incompressible medium, and the chemical liquid is pressurized through the partition membrane. A pressurizing system for the incompressible medium includes a bellows-type system as described in Japanese patent application laid-open publication No. 10-61558 and a syringe-type system using a piston as described in U.S. Pat. No. 5,167,837.

When the diaphragm or tube is elastically deformed by the incompressible medium to perform a pumping operation, the accumulation of the chemical liquid can be prevented in the expansion/contraction chamber of the pump, and generation of the particles due to the accumulation of the chemical liquid can be prevented. To the contrary, the incompressible medium serves as an important factor for determining performance of the pump. That is, when air enters into the incompressible medium from the outside, incompressibility of the incompressible medium is macroscopically lost, so that movement of the bellows or piston cannot be faithfully transmitted to the diaphragm or tube, and a movement stroke of the bellows or piston results in not corresponding to a discharge amount of chemical liquid. Similarly thereto, even when the incompressible medium leaks, the movement stroke of the bellows or the like results in not corresponding to the discharge amount of chemical liquid, so that the chemical liquid cannot be discharged with high accuracy.

In the syringe-type pump described above, a cylinder is generally provided with a seal member contacting with an outer peripheral face of the piston so that a region between an interior of the a driving chamber on a tip face side of the piston and the outside on a basal end face side of the piston is sealed. At this time, the piston regards the seal member as a boundary and reciprocates between a portion accommodating the incompressible medium and the outside. Therefore, in some cases, the piston may be exposed to the outside in a state where the incompressible medium adheres to an outer peripheral face of the piston. The adhered incompressible medium becomes a thin-film shape to enter into a region between the outer peripheral face and the seal member, and so serves as lubricant for avoiding direct contact between the seal member and the outer peripheral face of the piston. To the contrary, a portion of the incompressible medium exposed to the outside evaporates or dries little by little, thereby disappearing from a surface of the piston and resulting in decreasing an amount of incompressible medium. Further, when the incompressible medium exposed to the outside vaporizes, the incompressible medium functioning as lubricant disappears from the outer peripheral face of the piston, thereby becoming in a state of lacking an oil film. Therefore, since the seal member directly contacts with the outer peripheral face of the piston, frictional wear of the seal member progresses.

When the piston is moved backward in order to expand the pump chamber partitioned by the partition membrane and suck the chemical liquid contained in the container into the pump chamber, the incompressible medium becomes in a negative pressure state, so that external ambient air may enter into the incompressible medium from a region between the outer peripheral face of the piston and an inner peripheral face of the cylinder. This phenomenon becomes significant when a sealing property lowers due to the frictional wear of the seal member slidably contacting with the outer peripheral face of the piston. Also, the same phenomenon occurs even when large negative pressure is applied to the incompressible medium by the piston.

In contrast, in the bellows-type pump as described above, since a seal member contacting with a sliding face is not used, there is an advantage of a high airtight property of the pump chamber or driving chamber filled with the incompressible medium. However, pressure applied to the incompressible medium in the bellows-type pump is lower than that in the syringe-type pump. For example, when a resist is discharged to the nozzle through a filter, pressure in the pump chamber becomes high due to high flow resistance in the filter. When the bellow is driven, pressure of the incompressible medium becomes high and the bellows may slightly expand or contact. Therefore, when the bellows are slightly expands or contracts, the movement stroke of the bellows results in not corresponding to the discharge amount of chemical liquid with high accuracy.

An object of the present invention is to provide a chemical liquid supplying apparatus that can discharge the chemical liquid with high accuracy.

Another object of the present invention is to provide a chemical liquid supplying apparatus that can prevent the incompressible medium from leaking from a region between the piston and the cylinder.

Still another object of the present invention is to provide a chemical liquid supplying apparatus in which a lubricating property of the seal member can be improved by interposing a film of the incompressible medium in the seal member for sealing the region between the piston and the cylinder.

SUMMARY OF THE INVENTION

A chemical liquid supplying apparatus according to the present invention comprises: a pump provided with an elastically deformable partition membrane for partitioning a pump chamber and a driving chamber, the pump chamber communicating with a liquid inflow port and a liquid outflow port; a cylinder assembling reciprocably a piston for supplying and exhausting an incompressible medium to and from the driving chamber; driving means for reciprocating linearly the piston to expand and contract the pump chamber via the incompressible medium; and an elastically deformable diaphragm provided between the piston and the cylinder and forming a seal space continuous with a sliding portion between an outer peripheral face of the piston and an inner peripheral face of the cylinder, the incompressible medium being enclosed in the seal space.

The chemical liquid supplying apparatus according to the present invention further comprises a medium supply/exhaust portion forming an expansion/contraction chamber communicating with the seal space, the incompressible medium entering into and being exhausted from the expansion/contraction chamber in accordance with a volume change of the seal space when the piston reciprocates.

The chemical liquid supplying apparatus according to the present invention further comprises: a pump-side driving chamber partitioned by the partition membrane; a piston-side driving chamber formed in the cylinder; and a communicating hole causing the pump-side driving chamber and the piston-side driving chamber to communicate with each other, wherein the pump-side driving chamber, the piston-side driving chamber, and the communication hole are formed in a combined member having the cylinder and a pump case constituting the pump.

The chemical liquid supplying apparatus according to the present invention is such that a central portion of the diaphragm is mounted on a projecting portion of the piston, an outer peripheral portion of the diaphragm is mounted on the cylinder, and the seal space is formed outside the projecting portion of the piston.

The chemical liquid supplying apparatus according to the present invention is such that the partition membrane is a tube.

The chemical liquid supplying apparatus according to the present invention is such that the partition membrane is a diaphragm and that the diaphragm is mounted on the cylinder by the pump case attached to the cylinder, and the pump chamber and the driving chamber are partitioned by the diaphragm.

According to the present invention, the driving chamber to be filled with the incompressible medium is expanded and contracted by the piston to expand and contract the pump chamber through the incompressible medium, so that higher pressure can be applied to the incompressible medium than when the incompressible medium is pressurized by the bellows. For this reason, even if high flow resistance is applied to the pump chamber when the pump chamber is expanded and contracted, the chemical liquid can be supplied.

The seal space continuous with the sliding portion between the outer peripheral face of the piston and the inner peripheral face of the cylinder is formed by the diaphragm provided between the piston and the cylinder, and the incompressible medium is enclosed in this seal space. Thus, since the diaphragm for forming the seal space has no sliding portion, even if the incompressible medium enclosed in the seal space leaks from the sliding portion between the piston and the cylinder due to pressurization of the driving chamber by the piston, the incompressible medium flows into the seal space. Therefore, the incompressible medium is prevented from leaking outside the apparatus.

Thus, since the sliding portion between the outer peripheral face of the piston and the inner peripheral face of the cylinder is continuous with the seal space, the seal member for sealing the gap between the piston and the cylinder serves as a boundary and the incompressible medium adheres to and is left on both axial-directional sides of the seal member. Therefore, the incompressible medium becomes a thin-film shape and adheres to the seal member, the lubricating property of the seal member is enhanced, and wear of the seal member is prevented.

Even if the incompressible medium in the seal space enters into the driving chamber for the reason that pressure in the driving chamber is made lower than external pressure by driving the piston in a direction of expanding the driving chamber, compressible fluid such as air does not enter into the seal space. Therefore, the movement stroke of the piston is allowed to correspond to a deformation amount of the pump chamber with high accuracy, and a discharge amount of chemical liquid from the pump can be controlled with high accuracy.

Since the seal space continuous with the driving chamber via the sliding portion is formed by the diaphragm, even if the seal member provided in the sliding portion between the piston and the cylinder change with time and is worn, gas is prevented from entering into the driving chamber. Accordingly, a time period of replacing the seal member or carrying out maintenance can be set long, and durability of the chemical liquid supplying apparatus can be improved.

DESCRIPTION OF THE PREFERRED EMBODIMENTS

Figure 1:
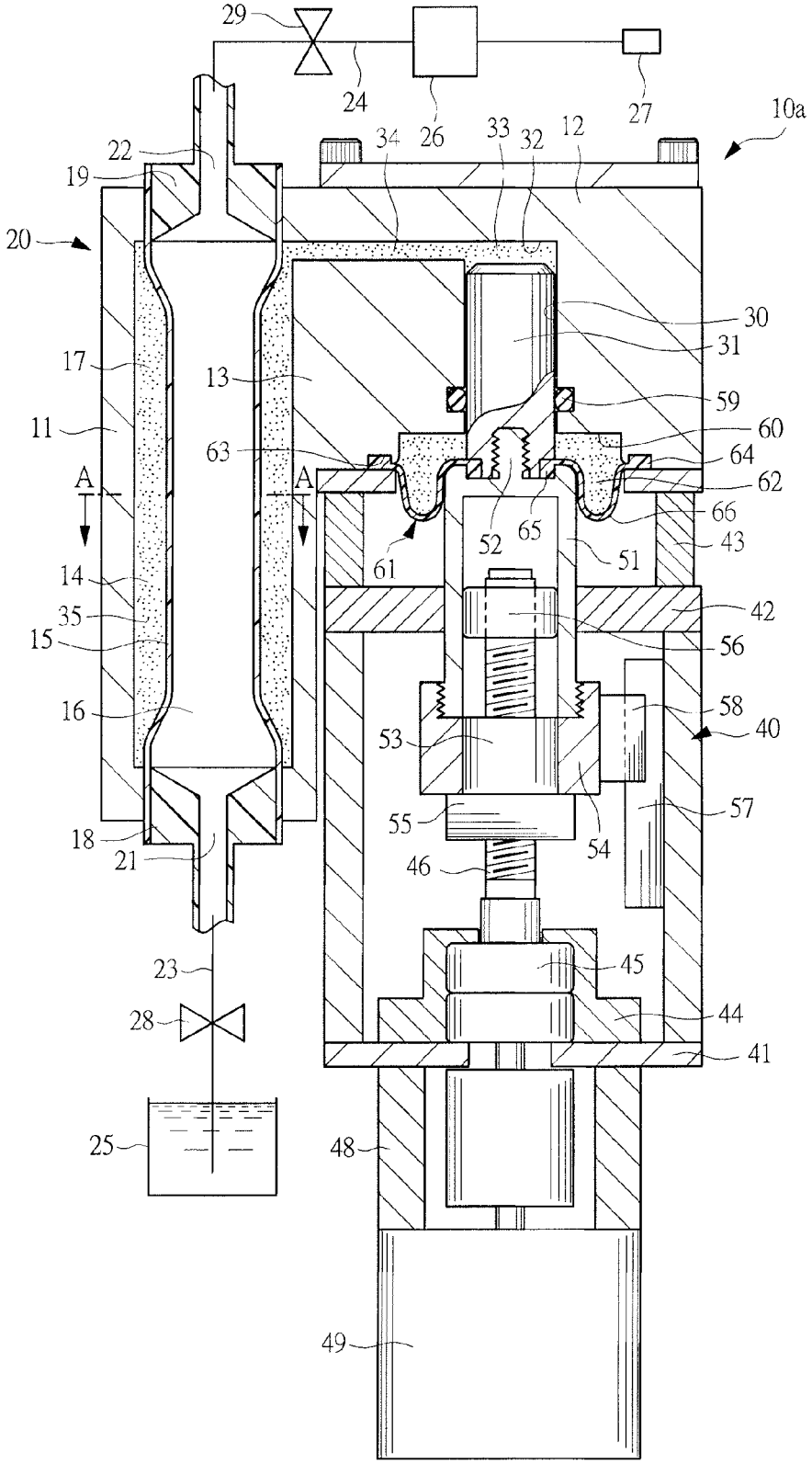
FIG. 1 is a sectional view showing a chemical liquid supplying apparatus according to an embodiment of the present invention.

Embodiments of the present invention will be described below with reference to the drawings. Members having common functions are denoted by the same reference numerals through all the drawings.

Figure 2:
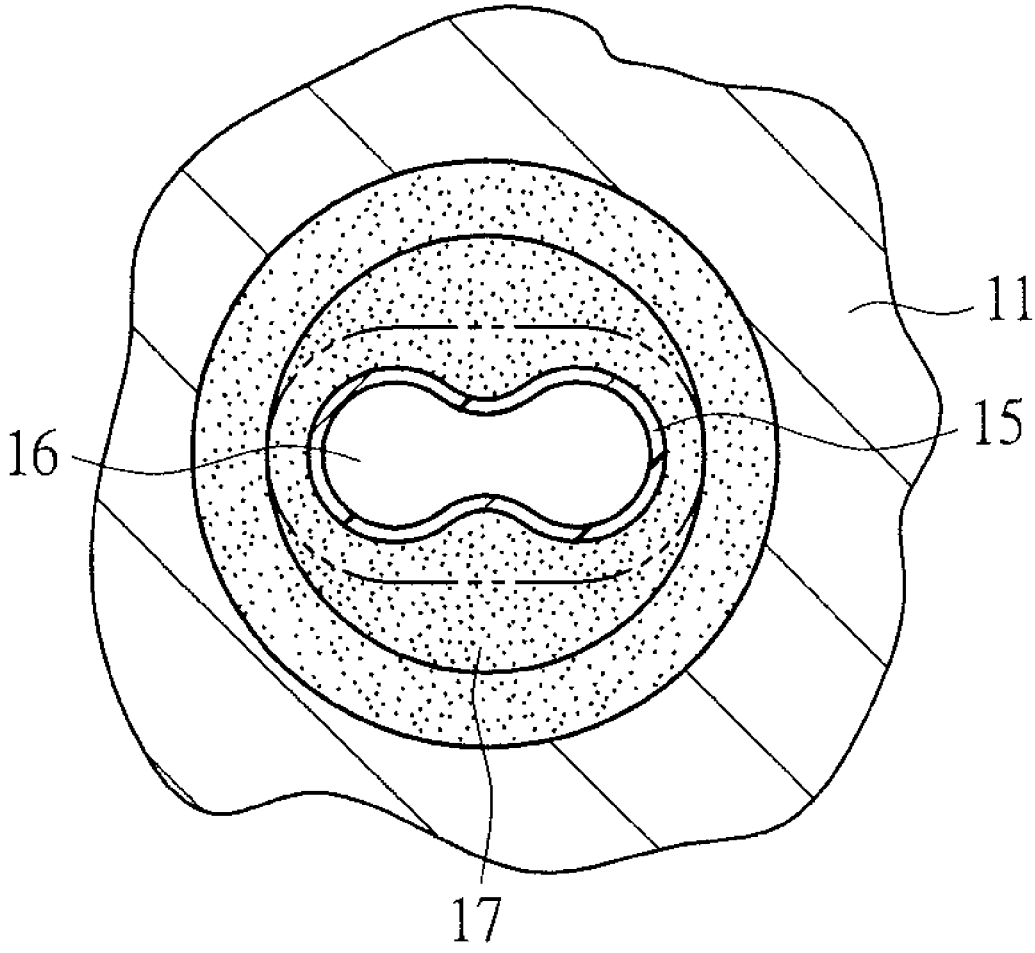
FIG. 2 is a sectional view taken along line A-A in FIG. 1.

FIG. 1 is a sectional view showing a chemical liquid supplying apparatus 10*a* according to an embodiment of the present invention. FIG. 2 is a sectional view taken along line A-A in FIG. 1. This chemical liquid supplying apparatus 10*a* has a combined member 13 including a pump case 11 and a cylinder 12 that are integrated with each other, wherein the pump case 11 and the cylinder 12 are parallel to each other. A flexible tube 15, which is formed of an elastic material and is radially expandable and contractible, is attached as a pump member inside a cylindrical space 14 in the pump case 11. The pump case 11 and the flexible tube 15 configure a pump 20. This flexible tube 15 partitions the space 14 into a pump chamber 16 and a pump-side driving chamber 17, which are respectively located inside and outside the flexible tube 15, so that the flexible tube 15 constitutes a partition membrane.

Adapter parts 18 and 19 are attached to both end portions of the flexible tube 15. A liquid flow inlet 21 communicating with the pump chamber 16 is formed in the adapter part 18 and is connected to a supply-side flow path 23. A liquid flow outlet 22 communicating with the pump chamber 16 is formed in the adapter part 19 and is connected to a discharge-side flow path 24. The supply-side flow path 23 is connected to a chemical liquid tank 25 accommodating chemical liquid such as resist liquid, and the discharge-side flow path 24 is connected to an application nozzle 27 via a filter 26.

The flexible tube 15 is made of tetrafluoroethylene perfluoroalkyl vinyl ether copolymer (PFA) which is a fluorine resin, and the adapter parts 18 and 19 are also made of PFA. These members made of PFA do not react with photoresist liquid. However, if flexible materials such as other resin materials or rubber materials are elastically deformable, they are not limited to PFA by kinds of chemical liquid and accordingly may be used as raw materials of the flexible tube 15 and the adaptor parts 18 and 19.

The supply-side flow path 23 is provided with a supply-side opening/closing valve 28 for opening and closing the supply-side flow path 23, and the discharge-side flow path 24 is provided with a discharge-side opening/closing valve 29 for opening and closing the discharge-side flow path 24. As the respective opening/closing valves 28 and 29, solenoid valves actuated according to electric signals or operation valves actuated according to air pressure are used. Check valves may be used as the opening/closing valves.

A piston 31 is assembled axially reciprocably into a bottomed cylinder bore 30 formed in the cylinder 12, and a piston-side driving chamber 33 is formed between a tip face of the piston 31 and a bottom face 32 of the cylinder bore 30, and the piston-side driving chamber 33 communicates with the pump-side driving chamber 17 through a communication hole 34 formed in the combined member 13. Liquid is enclosed, as an incompressible medium 35, in the pump-side driving chamber 17 and the piston-side driving chamber 33, and the incompressible medium 35 inside the pump-side driving chamber 17 communicates with that inside the piston-side driving chamber 33 via the communication hole 34. Accordingly, when the piston 31 is moved forwardly toward the bottom face 32, the piston-side driving chamber 33 is contracted and the incompressible medium 35 in this driving chamber 33 is caused to flow into the pump-side driving chamber 17, whereby the pump chamber 16 inside the flexible tube 15 is contracted. On the other hand, when the piston 31 is moved backwardly, the piston-side driving chamber 33 is expanded and the incompressible medium 35 inside the pump-side driving chamber 17 is caused to flow into the piston-side driving chamber 33, whereby the pump chamber 16 is expanded.

In the pump 20 including the flexible tube 15 and the pump case 11, when the piston 31 inside the cylinder 12 reciprocates, the pump chamber 16 expands and contracts according to movement of the incompressible medium 35 enclosed in both the driving chambers 17 and 33 and the chemical liquid in the chemical liquid tank 25 is supplied to the application nozzle 27 by performing opening and closing operations of the supply-side opening/closing valve 28 and the discharge-side opening/closing valve 29 in conjunction with expansion and contraction of the pump chamber 16. The pump case 11 constituting the pump 20 is provided integrally with the cylinder 12 and adjacently to the cylinder 12, and the communication hole 34 is formed in the combined member 13 integrated with the pump case 11 and the cylinder 12, so that downsizing of the chemical liquid supplying apparatus can be achieved. However, there may be adopted such a configuration that the pump case 11 and the cylinder 12 are formed using separate members and the separate members are connected to each other using a hose or pipe having a communication hole.

FIG. 2 is a sectional view taken along line A-A in FIG. 1, wherein the flexible tube 15 serving as a pump member is formed to have an oval in transverse section except for portions fitted to the adapter parts 18 and 19 and has flat portions and arc-shaped portions. As shown in FIG. 1, when the piston 31 substantially reaches a forward limit position, the flexible tube 15 is deformed for contraction as shown by a solid line in FIG. 2, i.e., so that the flat portions approach to each other. Meanwhile, when the piston 31 reaches a backward limit position, the flexible tube 15 is deformed for expansion as shown by a two-dot chain line in FIG. 2, i.e., so that the flat portions become an oval parallel to each other. However, a transverse-sectional shape of the flexible tube 15 is not limited to the oval shape and may have another shape.

A driving box 40, to one end of which a supporting plate 41 is attached and to the other end of which a guide plate 42 is attached, is attached to the cylinder 12 to reciprocate linearly the piston 31 via a spacer 43. A ball screw shaft 46 is rotatably supported at its basal end portion in a bearing 45 fixed inside the supporting plate 41 by a bearing holder 44, and the ball screw shaft 46 is coupled to a main shaft of a motor 49 serving as driving means and fixed outside the supporting plate 41 via a spacer 48, so that the ball screw shaft 46 is rotationally driven in both forward and backward directions by the motor 49.

A driving sleeve 51 is coupled to a rear end of the piston 31, the driving sleeve 51 includes an end wall portion provided integrally with a male screw portion 52 and a cylindrical portion integrated with the end wall portion, and the male screw portion 52 is screwed to the piston 31. The ball screw shaft 46 is concentrically assembled inside the driving sleeve 51, and a nut 53 to be screwed to the ball screw shaft 46 is fixed at an opening end portion of the driving sleeve 51 by a nut holder 54. The nut 53 has a flange 55 to be screwed to the nut holder 54, and the nut 53 is fixed to the nut holder 54 by the flange 55. When the ball screw shaft 46 is rotationally driven by the motor 49, the driving sleeve 51 is reciprocated axially linearly via the nut 53. A guide ring 56 is mounted on a tip portion of the ball screw shaft 46 so that the ball screw shaft 46 is not inclined during rotational driving of the ball screw shaft 46. When the piston 31 is driven via the driving sleeve 51 by the motor 49, a slide block 58 that slides along a guide rail 57 attached inside the driving box 40 is provided on the nut holder 54 in order to guide axial-directional movement of the driving sleeve 51.

In order to seal a region between the piston 31 and the cylinder 12, an annular groove is formed in the cylinder 12 and a seal member 59 is mounted in the annular groove, so that an outer peripheral face of the reciprocating piston 31 slidably contacts with the seal member 59. A concave portion 60 is formed on an opening portion side of the cylinder bore 30 in the cylinder 12, and an elastically deformable diaphragm 61 is provided between the cylinder 12 and a projecting end of the piston 31 so as to cover the concave portion 60. Therefore, a seal space 62 to be filled with the incompressible medium 35 is formed by the cylinder 12 and the diaphragm 61.

The diaphragm 61 includes: an annular portion 64 fixed in an annular groove 63 formed at the opening end portion of the cylinder 12; an annular portion 65 clamped between a projecting portion of the piston 31 and the driving sleeve 51; and an elastically deformable portion 66 provided between the annular portion 64 and the annular portion 65. The diaphragm 61 is made of an elastically deformable member such as a rubber material, a resin material, a metal material, or the like.

By using this chemical liquid supplying apparatus 10*a*, the piston-side driving chamber 33 is pressurized by the piston 31 to supply the incompressible medium 35 to the pump-side driving chamber 17 from the piston-side driving chamber 33, whereby pressure in the pump-side driving chamber 17 can be raised. The incompressible medium 35 inside the piston-side driving chamber 33 is sealed by the seal member 59. On the other hand, when the piston-side driving chamber 33 is pressurized by the piston 31, there may be such a drawback that the incompressible medium 35 adhering to the outer peripheral face of the piston 31 passes, without any change, through the seal member 59 according to pressure in the piston-side driving chamber 33, thereby leaking from the opening end of the cylinder 12 to the outside. However, the incompressible medium 35 that has adhered thereto and leaked to the outside is taken in the incompressible medium 35 inside the seal space 62, thereby being prevented from leaking to the outside of the apparatus. Since the diaphragm 61 has no sliding portion, the incompressible medium 35 that has leaked from the cylinder bore 30 is prevented from scattering from the seal space 62 to the outside.

Even if the incompressible medium 35 inside the piston-side driving chamber 33 and the pump-side driving chamber 17 is put in a negative pressure state when a volume of the piston-side driving chamber 33 is increased by moving the piston 31 backwardly, the projecting end portion of the piston 31 is shielded from the outside by the diaphragm 61. Therefore, even if the incompressible medium 35 sealed inside the seal space 62 is caused to reversely flow into and enter into the piston-side driving chamber 33, external air is prevented from entering into the piston-side driving chamber 33.

In addition, since the sliding portion between the piston 31 and the cylinder 12 is continuous with the seal space 62 airtightly kept, an amount of incompressible medium 35 that leaks to the outside through a fine gap between the seal member 59 and a surface of the piston and enters into its interior from the outside can be reduced. Since molecular weight of the incompressible medium 35 which is liquid is larger than that of gas, it has difficulty in passing through the fine gap between the seal member 59 and the surface of the piston. Accordingly, when the piston 31 is moved backwardly, an amount of the incompressible medium 35 entering into the piston-side driving chamber 33 and the pump-side driving chamber 17 from the seal space 62 becomes little as compared with the case of filling the seal space 62 with gas, whereby discharge precision can be maintained for a long period.

Further, the seal member 59 for sealing a region between the piston 31 and the cylinder 12 serves as a boundary, and the incompressible medium 35 adheres to and is left on both axial-directional sides of the seal member 59. Therefore, the incompressible medium 35 becomes a thin-film shape to adhere to the seal member 59, so that a lubrication property of the seal member 59 is enhanced, wear of the seal member 59 is prevented, durability of the seal member 59 is improved, and the lifetime of the apparatus is extended.

Also, even if the seal member 59 wears by changing with time and the sealing property thereof lowers, air is prevented from entering into the piston-side driving chamber 33, which makes it possible to have the discharge amount of chemical liquid from the flexible tube 15 correspond to the reciprocating stroke of the piston 31 with high accuracy. Accordingly, when photoresist liquid is applied to the semiconductor wafer, a fixed amount of photoresist liquid can be discharged from the application nozzle 27 with high accuracy.

Figure 3:
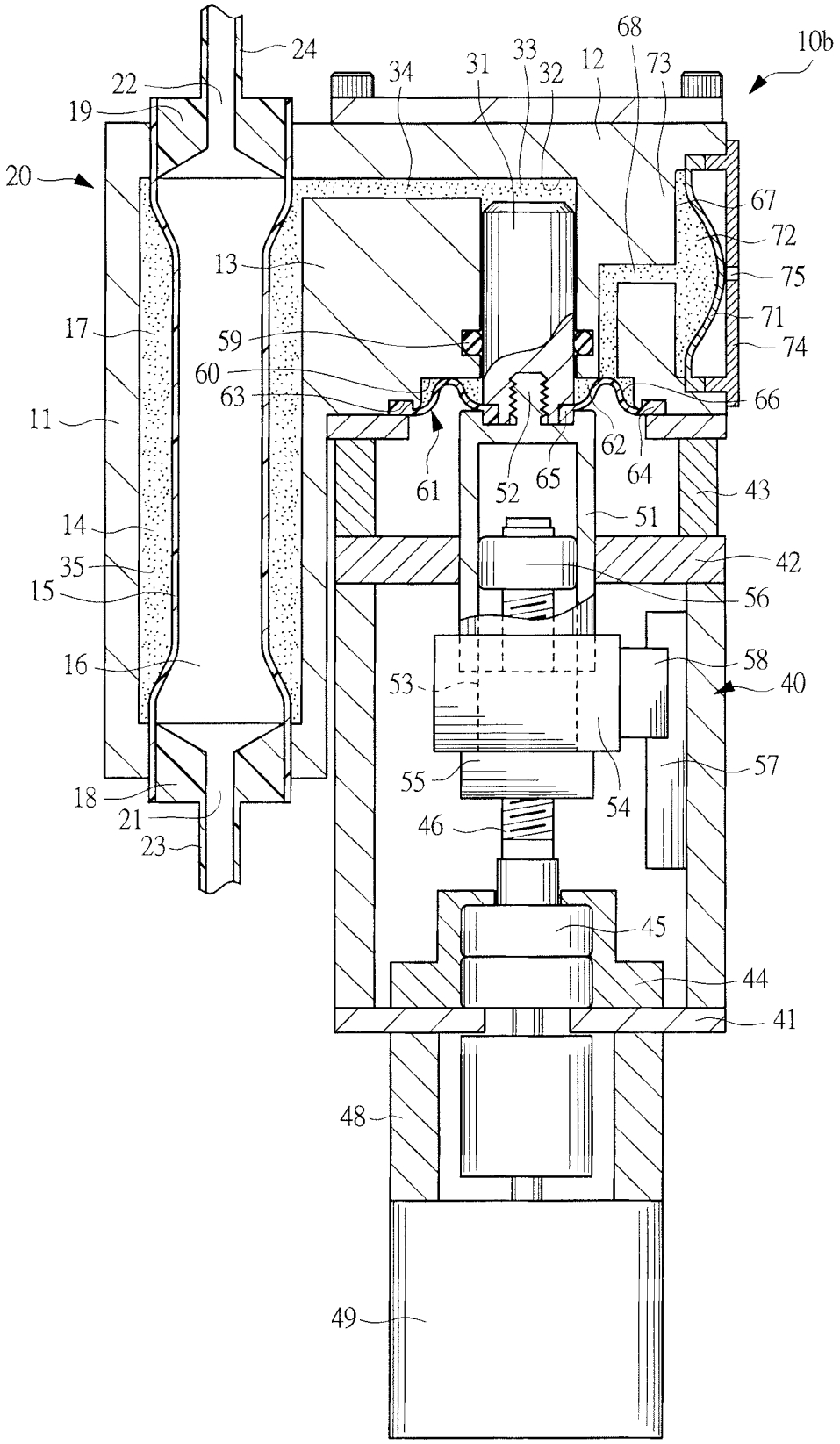
FIG. 3 is a sectional view showing a chemical liquid supplying apparatus according to another embodiment of the present invention.

FIG. 3 is a sectional view showing a chemical liquid supplying apparatus according to another embodiment of the present invention. In this chemical liquid supplying apparatus 10*b*, a concave portion 67 is formed on a side face of the cylinder 12, the concave portion 67 communicates with the seal space 62 between the diaphragm 61 and the piston 31 via a communication hole 68, and the concave portion 67 communicates with the outer peripheral face of the piston 31 via a seal space 62 and the communication hole 68. An elastically deformable diaphragm 71 made of rubber or the like is attached to the concave portion 67, and a volume-variable expansion/contraction chamber 72 is formed by the concave portion 67 and the diaphragm 71, so that the incompressible medium 35 is allowed to be sealed inside the expansion/contraction chamber 72 and a portion which has formed the concave portion 67 in the cylinder 12 serves as a medium supply/exhaust portion 73. The diaphragm 71 is formed of a rubber material or the like in the same manner as the diaphragm 61 and is fixed to the medium supply/exhaust portion 73 by a lid member 74 fixed to the cylinder 12, and the diaphragm 71 is elastically deformable in a space located inside the lid member 74, and further an air sucking hole 75 is formed in the lid member 74. Incidentally, so long as any member can absorb a volume change of the expansion/contraction chamber 72, such a member is not limited to a diaphragm and may use a bellows.

In the chemical liquid supplying apparatus shown in FIG. 3, when the piston 31 reciprocates, a volume of the seal space 62 changes according to reciprocating movement, whereby a volume in the expansion/contraction chamber 72 changes according to the volume change. That is, when the piston 31 moves down to a position lower than a position shown in FIG. 3, the volume of the seal space 62 increases, so that the incompressible medium 35 flows into the seal space 62 from the expansion/contraction chamber 72 according to an increase in the volume, thereby being refilled. For this reason, the expansion/contraction chamber 72 is contracted. Meanwhile, when the piston 31 moves in a reverse direction to decrease the volume of the seal space 62, the incompressible medium 35 inside the seal space 62 is exhausted to the expansion/contraction chamber 72 and the expansion/contraction chamber 72 is expanded. Incidentally, a medium supply/exhaust portion 73 may be provided so as to be separated from the cylinder 12. In this case, the cylinder 12 and the medium supply/exhaust portion 73 are coupled to each other via a hose or the like having the communication hole 68.

Figure 4:
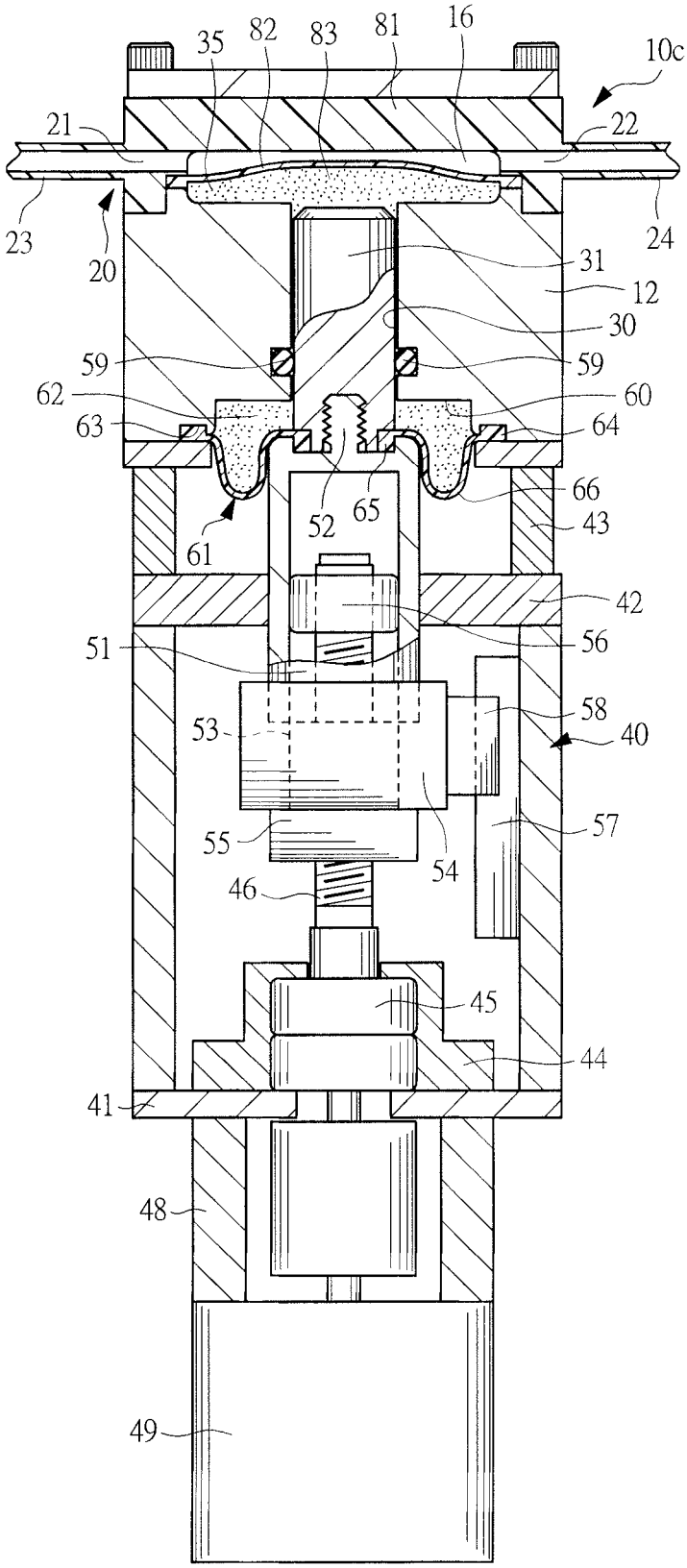
FIG. 4 is a sectional view showing a chemical liquid supplying apparatus of still another embodiment of the present invention.

FIG. 4 is a sectional view showing a chemical liquid supplying apparatus according to still another embodiment of the present invention. In this chemical liquid supplying apparatus 10*c*, a pump case 81 is attached to an end face of the cylinder 12. The pump case 81 is made of PFA and provided integrally with the supply-side flow path 23 and the discharge-side flow path 24. However, the supply-side flow path 23 and the discharge-side flow path 24, which are formed separately from the pump case 81, may be attached to the pump case 81.

A diaphragm 82 made of an elastic material such as PTFE is attached, as a pump member, between the pump case 81 and the cylinder 12, wherein the pump case 81 and the diaphragm 82 constitute the pump 20. A space between the pump case 81 and the cylinder 12 is partitioned into the pump chamber 16 and a driving chamber 83 by this diaphragm 82, so that the diaphragm 82 constitutes a partition membrane.

In the chemical liquid supplying apparatus 10*c* shown in FIG. 4, the driving chamber 83 partitioned by the diaphragm 82 has both functions as the pump-side driving chamber 17 and the piston-side driving chamber 33 as described above, whereby the chemical liquid supplying apparatus 10*c* is further downsized as compared with the above-mentioned chemical liquid supplying apparatuses 10*a* and 10*b*.

Also in the respective chemical liquid supplying apparatuses 10*b* and 10*c*, pressure in the pump-side driving chamber 17 can be raised like the chemical liquid supplying apparatus 10*a*, so that even if the pressure is raised, the incompressible medium 35 is prevented from leaking outside the apparatus. Since the diaphragm 61 has no sliding portion, the incompressible medium 35 that has leaked from the cylinder bore 30 is prevented from scattering from the seal space 62 to the outside.

Further, even if the incompressible medium 35 inside the piston-side driving chamber 33 and the pump-side driving chamber 17 becomes a negative pressure state when the piston 31 is moved backwardly to increase the volume in the piston-side driving chamber 33, external air is prevented from entering into the piston-side driving chamber 33. Since the sliding portion between the piston 31 and the cylinder 12 is continuous with the seal space 62 airtightly kept, an amount of incompressible medium 35 which leaks to the outside through a fine gap between the seal member 59 and the surface of the piston and enters therein from the outside can be reduced.

The seal member 59 for sealing a region between the piston 31 and the cylinder 12 serves as a boundary so that the incompressible medium 35 adheres to and is left on both axial-directional sides of the seal member 59. Therefore, the incompressible medium 35 becomes a thin-film shape and adheres to the seal member 59, a lubrication property of the seal member 59 is enhanced, wear of the seal member 59 is prevented, durability of the seal member 59 is improved, and the lifetime of the apparatus can be extended. Even if the seal member 59 changes with time and is worn to lower the sealing property, air can be prevented from entering into the piston-side driving chamber 33.

Also, the present invention can have the discharge amount of chemical liquid from the pump chamber 16 correspond to the reciprocating stroke of the piston 31 with high accuracy. Accordingly, when the photoresist liquid is applied to the semiconductor wafer, the fixed amount of photoresist liquid can be discharged from the application nozzle 27 with high accuracy.

The expansion/contraction chamber 72 whose volume is varied by the diaphragm 71 shown in FIG. 3 may be provided in the chemical liquid supplying apparatus 10*c* shown in FIG. 4.

In the chemical liquid supplying apparatuses 10*b* and 10*c* shown in FIGS. 3 and 4, the chemical liquid tank 25, the application nozzle 27, and the like are omitted. However, the respective chemical liquid supplying apparatuses can apply chemical liquid to a material to be applied such as a semiconductor wafer.

The present invention is not limited to the above-mentioned embodiments and may be variously modified without a scope of not departing from the gist of the present invention. For example, although the piston 31 is driven by the motor 49, the driving means is not limited to the motor 49 and another driving means such as an air pressure cylinder may be used.

What is claimed is:

1. A chemical liquid supplying apparatus comprising:

a cylinder formed with a cylinder bore;

a piston assembled axially reciprocally into the cylinder bore;

a seal member mounted in an annular groove formed in the cylinder, wherein an outer peripheral face of the piston slidably contacts the seal member, a pump case attached to an end face on which the cylinder bore opens, wherein the pump case has a liquid flow inlet and a liquid flow outlet;

an elastically deformable partition membrane provided in a space formed between the pump case and the end face of the cylinder, wherein the partition membrane partitions the space into a driving chamber and a pump chamber, the driving chamber communicates with the cylinder bore, the driving chamber is filled with incompressible medium, the pump chamber communicates with the liquid flow inlet and the liquid flow outlet, and the pump chamber is filled with chemical liquid;

driving means for reciprocating the piston to expand and contract the pump chamber via the incompressible medium in the driving chamber; and an elastically deformable diaphragm provided between the piston and the cylinder, the diaphragm having an elastically deformable portion, wherein the diaphragm forms a seal space separated by the piston and the seal member from the driving chamber, wherein the diaphragm deforms to absorb a volume change of the seal space caused by leakage of the incompressible medium between the piston and the cylinder, and to hold in the seal space incompressible medium leaked from the driving chamber as the piston continues to reciprocate.

2. The chemical liquid supplying apparatus according to claim 1, wherein a central portion of the diaphragm is mounted on a projecting portion of the piston, an outer peripheral portion of the diaphragm is mounted on the cylinder, and the seal space is formed outside the projecting portion of the piston.

3. The chemical liquid supplying apparatus according to claim 1, wherein the partition membrane is a partition member diaphragm.

4. The chemical liquid supplying apparatus according to claim 3, wherein the partition member diaphragm is mounted on the cylinder by the pump case attached to the cylinder, and the pump chamber and the driving chamber are partitioned by the partition member diaphragm.

* * * * *